US005452920A

United States Patent [19]

Parker

[11] Patent Number: 5,452,920

[45] Date of Patent: Sep. 26, 1995

[54] ADHESIVE BINDING STRIP AND METHOD OF MAKING THE SAME

[76] Inventor: Kevin P. Parker, 2015 Del Norte St., Berkeley, Calif. 94707

[21] Appl. No.: 195,690

[22] Filed: Feb. 16, 1994

[51] Int. Cl.[6] ..... B42D 1/00

[52] U.S. Cl. ..... 281/21.1; 281/36; 412/8; 412/36

[58] Field of Search ..... 281/15.1, 21.1, 281/36; 412/8, 37, 41, 900, 902, 1, 36

[56] References Cited

U.S. PATENT DOCUMENTS

| | | | |
|---|---|---|---|
| D. 238,000 | 12/1975 | Patla | D18/34 |
| 3,518,143 | 6/1970 | Fuhr | 412/37 |
| 3,531,358 | 9/1970 | Rost et al. | 156/475 |
| 3,715,260 | 2/1973 | Dornemann et al. | 156/477 |
| 3,788,921 | 1/1974 | Polit et al. | 156/216 |
| 3,847,718 | 11/1974 | Watson | 281/21.1 |
| 3,911,517 | 10/1975 | Davis | 11/1 R |
| 3,928,119 | 12/1975 | Sarring | 156/477 |
| 3,954,548 | 5/1976 | Polit | 156/477 |
| 3,956,057 | 5/1976 | Jung | 156/908 |
| 3,992,741 | 11/1976 | Staats | 412/900 |
| 4,151,037 | 4/1979 | Klingelhoefer et al. | 156/477 |
| 4,178,201 | 12/1979 | Power et al. | 412/900 |
| 4,289,330 | 10/1981 | Wiermanski | 281/21 |
| 4,496,617 | 1/1985 | Parker | 428/55 |
| 4,531,874 | 7/1985 | Voges | 412/37 |
| 4,552,497 | 11/1985 | Kockler et al. | 412/6 |
| 4,678,386 | 7/1987 | Wiholm | 412/8 |
| 4,818,168 | 4/1989 | Battisti | 412/8 |
| 4,986,713 | 1/1991 | Zoltner et al. | 412/33 |
| 5,052,873 | 10/1991 | Parker | 412/13 |
| 5,156,510 | 10/1992 | Uehara | 281/21.1 |
| 5,193,962 | 3/1993 | Parker | 412/8 |

*Primary Examiner*—Willmon Fridie
*Attorney, Agent, or Firm*—Limbach & Limbach

[57] ABSTRACT

An adhesive binding strip for binding pages in the form of a book. The adhesive binding strip includes an elongated substrate made of a formable material. A band of heat-activated adhesive runs down the central portion of the substrate. A matrix of heat-activated adhesive is placed on the substrate around all edges of the adhesive band. The adhesive band, which has a low viscosity under activation conditions, binds the pages of a book to each other and to the substrate. The adhesive matrix, which has a high viscosity under activation conditions, serves to bind the entire substrate to the book, while preventing the adhesive band from running out from under the substrate during the binding process. The adhesive matrix also increases overall strength of the binding, especially with respect to the front and back cover pages of the book.

21 Claims, 4 Drawing Sheets

ADHESIVE BINDING STRIP AND METHOD OF MAKING THE SAME

BACKGROUND OF THE INVENTION

1. Field of the Invention

This present invention relates generally to the field of binding pages together in book form, and more particularly, to adhesive binding means and methods utilizing substrate strips backed with various heat-activated adhesives.

2. Background Art

It is often desirable to bind pages in book form. While clips and staples are often used to bind pages, pages bound by these means are frequently inadvertently pulled out and lost. Books bound by means of adhesives can be made to resist separation of pages and are thus more durable.

Furthermore, pages bound by means of adhesives can be more precisely constrained relative to each other. For this reason the pages of an adhesive bound book can be kept in flush alignment. This makes pages bound by means of adhesives more aesthetically attractive and easier to use.

The adhesives holding the pages of a bound book are preferably covered by heavy substrate of formable material. One reason is that printing can be placed on this substrate, and this printing will be visible when the book is viewed edge-wise. Another reason for using a substrate covering is that the outer substrate surface insulates the adhesive and the bound edges of the pages, which prevents wear on the binding. Another reason for using a substrate covering is that such substrates are considered more aesthetically appealing than exposed adhesive. Yet another reason for using a substrate covering is that the substrate is a convenient vehicle for applying adhesive to the pages during the binding process.

In response to this demand for heat-activated adhesive book bindings, several types of adhesive strips have been developed to bind pages. The principle behind these adhesive binding strips is that a piece of formable substrate material carries adhesive on one of its surfaces. The strip is placed across the edge of a stack of pages to be bound, heated to activation temperature, and then cooled so that the adhesive bonds all pages in the stack configuration. The adhesive remains substantially between the bound edges of the pages and the substrate strip.

U.S. Pat. No. 3,531,358 to Rost et al., discloses an adhesive strip which is wrapped partially around the first and last pages, herein sometimes referred to as the cover pages, of the book to form a larger bond area with the cover pages. This provides a more durable bond between the adhesive strip and cover pages.

One shortcoming present in some adhesive binding strips is that the adhesives which provide optimum bonding characteristics exhibit a low viscosity plastic state during the binding process, and as a result, the adhesive runs out from under the sides of the substrate strip onto the cover pages. Adhesive may also run out at the ends of a book binding.

U.S. Pat. No. 4,496,617 to Parker, which is hereby incorporated by reference, discloses a dual adhesive binding strip which overcomes part of the previously-described shortcoming of adhesive run out. The dual adhesive binding strip there disclosed employs a relatively thick (i.e. dimensionally thick in the direction normal to the surface of the substrate), high viscosity adhesive band on either side of a low viscosity adhesive band. These adhesive bands run in the direction of the desired binding (hereinafter called the "longitudinal" direction). The low viscosity adhesive band provides optimum bonding to the pages of the book. The relatively thick high viscosity adhesive bands are sufficient to bond the cover pages, while being of sufficient thickness to keep the low viscosity adhesive from running out of the longitudinal sides of the substrate strip.

Heat-activated strips according to this configuration may be bound by a machine disclosed in U.S. Pat. No. 5,052,873 to Parker. The machine there disclosed moves a binding strip into position abutting a stack of pages. The machine applies heat and pressure, sufficient to activate the adhesives, to the portion of the strip over the front cover, the portion of the strip over the page edges, and the portion of the strip over the back cover. When the adhesive cool, a finished binding results.

However, the potential problem of adhesive run out at the ends of the book binding remains. Adhesive run out at the ends of the substrate strip is aesthetically unattractive to the extent that exposed adhesive sets and hangs off of the ends of the book binding. Adhesive run out at the ends of the substrate strip is also a problem to the extent that the adhesive run out falls away from the book. This kind of adhesive run out is troublesome especially when it contaminates the workings of a binding machine, thereby causing binding machine failure.

One attempted accommodation is disclosed in U.S. Pat. No. 3,847,718 to Watson. This patent discloses a relatively thick band of low viscosity adhesive surrounded by a much thinner area of high viscosity adhesive. However, the potential for run out of the low viscosity adhesive remains because relatively thick low viscosity adhesive band can spill over the thin layer of high viscosity adhesive.

When the adhesive band is set back sufficiently away from the ends of the substrate to prevent run out, however, a thickness discontinuity can be observed in the finished bindings at the ends of the binding in the area where the low viscosity ends and the high viscosity adhesive begins.

Furthermore, the thin layer of high viscosity adhesive at the end of the binding does not adhere well to the edges of the bound pages, and as a result, a short fringe at each end of the substrate material remains unbound to the pages. While this unbound substrate material does not interfere with the creation of a strong bind, this free-hanging substrate gives the appearance of a poor bind. Also, small tears may develop in the free-hanging substrate, which exacerbates the appearance of a poor bind. Furthermore, there is a potential for increased wear on the corners of the pages at the ends of the binding.

The present invention overcomes the above-noted disadvantages of prior art devices. The disclosed adhesive binding strip provides for placement of high viscosity adhesive all around a low viscosity adhesive band. The low viscosity adhesive provides optimal bonding to the pages. The high viscosity adhesive can be placed on the substrate so that it will bind the entire substrate strip to the pages while preventing any run out of the low viscosity adhesive. These and other advantages of the subject invention will become apparent upon a reading of the following detailed description of the invention together with the appended claims and the drawings.

SUMMARY OF THE INVENTION

An adhesive binding strip and method for binding a stack of pages in a book-like fashion is disclosed. The adhesive binding strip includes an elongated substrate made of a formable material such as heavy paper. A band of heat-activated adhesive is disposed over the substrate along the longitudinal axis of the substrate. A matrix of heat-activated adhesive is disposed on the substrate all around the adhesive band. The thickness of the adhesive matrix is at least one-half the thickness of the adhesive band.

The adhesive band of the subject adhesive binding strip is comprised of heat-activated adhesive which exhibits a low viscosity when activated. The adhesive band serves to bind an edges of the stack of pages relative to each other and to bind the substrate relative to the bound edge of the stack of pages.

The adhesive matrix is comprised of one or more adhesives which exhibit a high viscosity, relative to that of the adhesive band, when said adhesives are activated. The adhesive matrix serves to contain the low viscosity adhesive band when the adhesives are activated. The adhesive matrix further serves to bond a greater area of the substrate to the pages, thereby enhancing the appearance of the binding.

A method for making an adhesive binding strip is disclosed. An elongated substrate of a formable material is supplied. Along the longitudinal axis of the substrate, an adhesive band of heat-activated adhesive is applied. An adhesive matrix of heat-activated adhesive is applied to the substrate strip. The adhesive matrix extends around the adhesive band and has a thickness of at least one-half the thickness of the adhesive band. Under activation conditions, the heat-activated adhesives of the adhesive band have a lower viscosity than the heat-activated adhesives comprising the adhesive matrix.

DETAILED DESCRIPTION OF THE INVENTION

Figure 1:
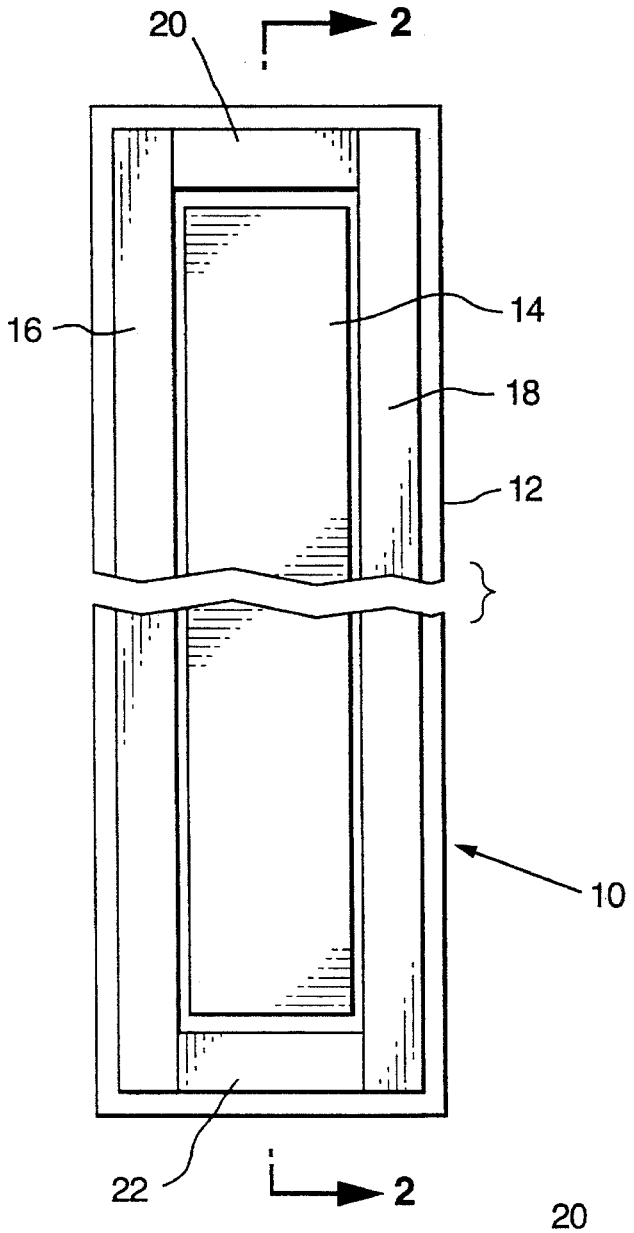
FIG. 1 is a plan view of an alternative embodiment of the subject adhesive binding strip showing the adhesive surface.
Figure 2:
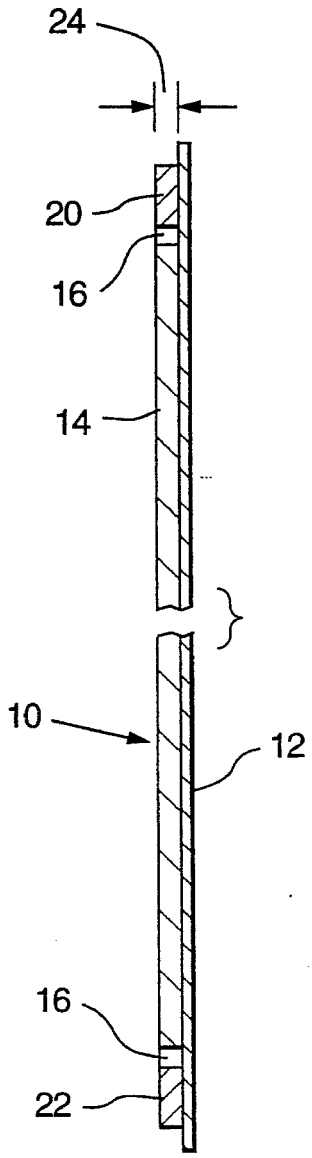
FIG. 2 shows a cross-sectional side view of the subject adhesive binding strip taken through section line 2—2 of FIG. 1.
Figure 3:
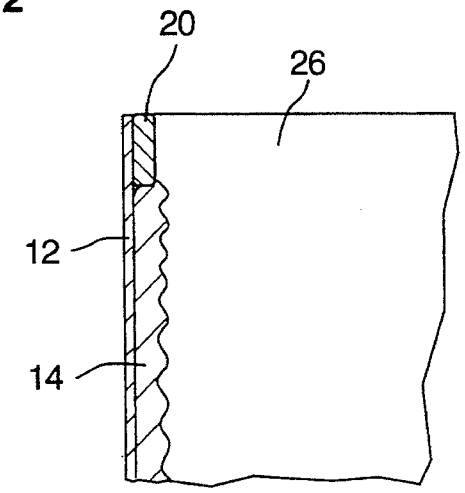
FIG. 3 is a partial cross-sectional view (not to scale) of a book showing distribution of adhesives at one end of a binding which incorporates an embodiment of the subject adhesive binding strip.
Figure 4:
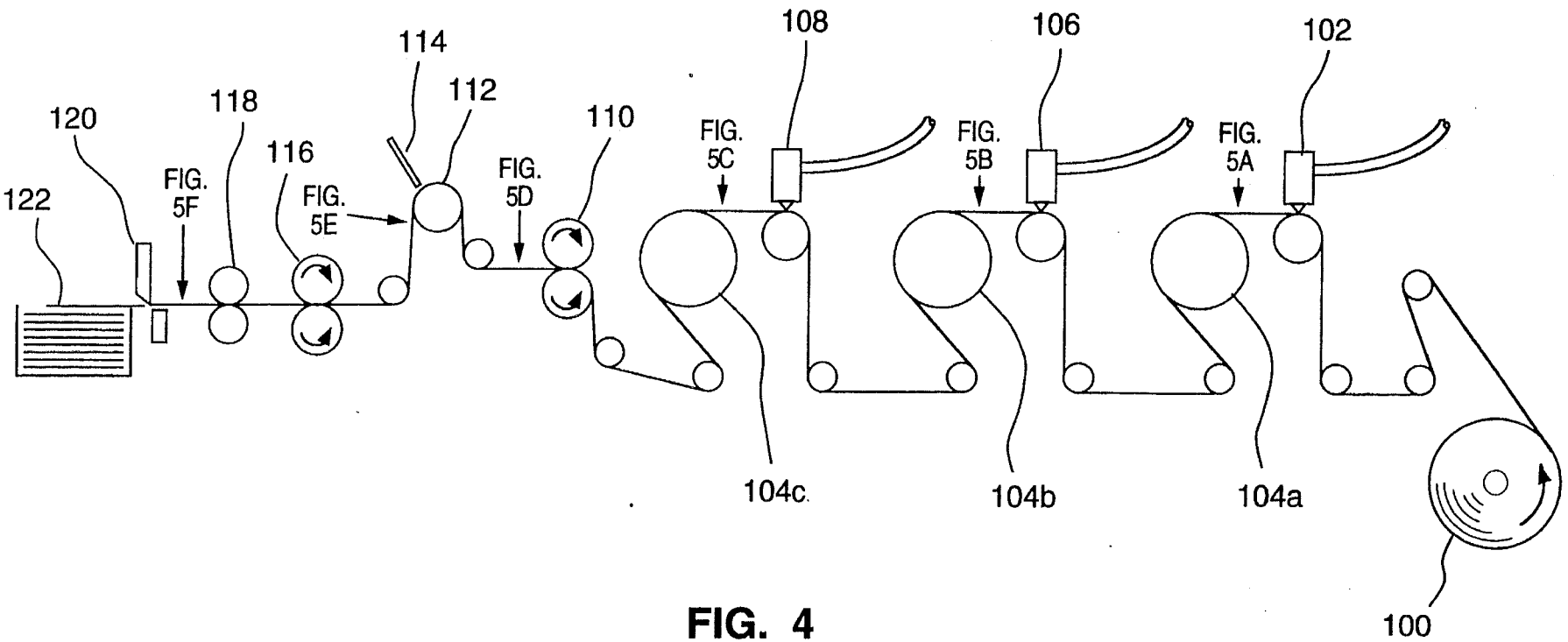
FIG. 4 shows an apparatus for practicing the invention and for making an embodiment of the invention.

Referring now to the drawings, an exemplary embodiment of the subject adhesive binding strip is shown in FIGS. 1 and 2. One end of a finished binding incorporating an embodiment of the subject adhesive binding strip is shown in FIG. 3 (not to scale). FIG. 3 is a cross-sectional view which cuts between two intermediate pages of the book.

The adhesive binding strip, generally designated by reference numeral 10, includes an elongated substrate 12 made of a formable material. The adhesive binding strip further includes an adhesive band 14 of heat-activated adhesive extending longitudinally down the central portion of the substrate 12. The adhesive binding strip 10 further includes heat-activated adhesive segments 16, 18, 20, 22 which form an adhesive matrix which extends completely around the adhesive band 14.

Substrate 12 is preferably fabricated from a heavy paper stock. However, any formable material which can form a bond with the adhesives of the adhesive band and segments, and can withstand the activation temperatures of the adhesives may be used. The substrate 12 is used to form the outer surface of a book binding. In a finished binding the substrate runs over the bound edge of the pages and also folds over a portion of the front and back cover pages of the book.

Adhesive band 14 and adhesive segments 16, 18, 20 and 22 are shown in FIG. 2 to have a thickness designated by reference numeral 24. The adhesive segments 16, 18, 20 and 22 preferably have a thickness of at least one-half the thickness of the adhesive band in order to prevent run out of the low viscosity adhesive, which comprises the adhesive band 14 during the binding process. Embodiments of the present invention in which the thickness of the adhesive band 14 and the adhesive segments 16, 18, 20 and 22 are equal, as shown in FIG. 2, have been found to produce finished binds without significant discontinuities, or ridges.

Adhesive band 14 comprises a heat-activated adhesive and is the primary means for bonding all pages into a bound book to each other and to the substrate 12. This heat-activated adhesive should be somewhat flexible or resilient at room temperature because the adhesive band 14 will undergo deformation in a finished bind when the book is open and shut.

Under activation conditions, the adhesive band 14 preferably has a viscosity of less than 10,000 centipoise (cps). It is even more preferred that the viscosity of the adhesive band, under activation conditions, be less than 6,000 cps. The reason for this is that it is believed that a better binding is made when adhesive runs some distance into the narrow gaps between the pages of a book. This is shown in the adhesive band 14 of FIG. 3. It is further believed that the lower the adhesive viscosity at activation temperature, the more likely it is that the adhesive will run sufficiently into the gaps between pages in response to forces applied during the binding process and by capillary action. A heat-activated adhesive manufactured by the H. B. Fuller Company of St. Paul, Minn., which is designated by product no. HM-1330 and which is commonly used in book-binding applications, has been found suitable for the present application.

Adhesive segments 16 and 18 run longitudinally along the substrate and serve to bond the front and back covers to the book. Adhesive segments 16 and 18 comprise a heat-activated adhesive having a viscosity, under activation conditions, greater than that of the adhesive band 14. The adhesive comprising adhesive segments 16 and 18 should be chosen to provide a strong bind with the material comprising the front and back covers of books which will be bound.

Figure 6:
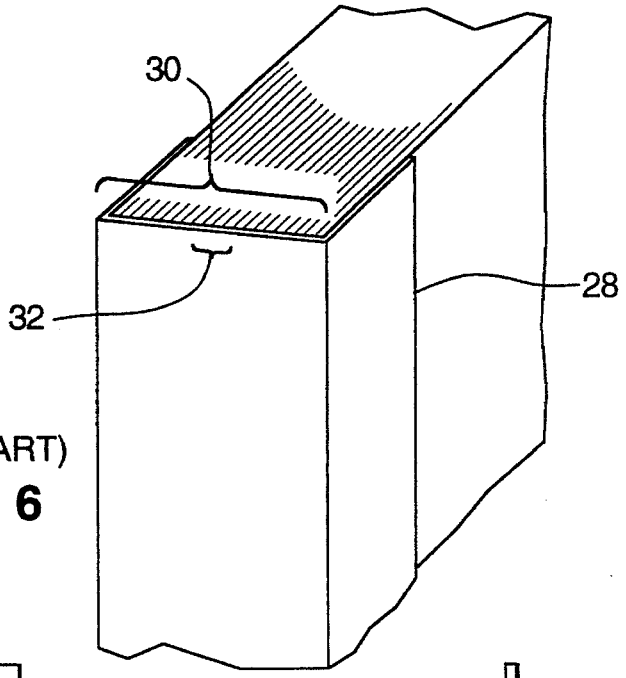
(PRIOR ART) FIG. 6
FIG. 6 is a prospective view of a finished prior art binding.

Adhesive segments 20 and 22 have several functions. One function of these adhesive segments is to prevent adhesive run out at the end of the binding. FIG. 6 shows a prior art binding using an adhesive strip 28. Under this prior art there was a potential for adhesive run out in the area designated by reference numeral 30. However in the present embodiment, the adhesive segment 20 prevents adhesive band 14 from running out of the end of the binding by blocking the adhesive at the interface between adhesive segment 20 and adhesive band 14, as shown in FIG. 3. Adhesive run out at the end of the binding is highly undesirable because exposed adhesive run out which adheres to the book is considered unsightly. During the binding process this run out can also potentially contaminate and interfere with the workings of a binding machine.

It should be noted that the adhesive segments 20 and 22 should preferably be at least one-half the thickness of the adhesive band 14 in order to effectively block the flow of the adhesive band 14 under activation conditions.

Adhesive segments 20 and 22 are also of such a thickness and composition, namely heat-activated adhesive, that the strips of the present embodiment are generally compatible with existing binding machines that were built for prior art binding strips which did not contain adhesive segments 20 and 22.

Furthermore, adhesive segment 20 can be placed so that it bonds the entire substrate 12 without leaving a fringe of unbound substrate material. In other words, the end of the substrate 12, the top of the pages 26, and the end of the adhesive segment 20 can be made to be substantially flush with each other. This is important partially because it is advantageous to avoid adhesive run out at the end of the binding as discussed above.

Alternatively, if there is a fringe of unbound substrate material hanging freely at the end of the binding, then the bind is aesthetically unappealing. FIG. 6 shows the potential location for such an unbound fringe in the area designated by reference numeral 32. Small tears can form in this hanging fringe. This makes the binding appear weak. The hanging fringe may also bend away from the corner of the pages of the book, exposing the corners to increased wear. In many applications, such as in government or legal books, aesthetics are an important consideration. The sloppy, weak and worn appearance which can be caused by a hanging fringe of substrate makes these bindings less suitable for such applications.

The embodiment shown in FIG. 3 overcomes these problems. It should be noted that the adhesive segments 20 and 22 should preferably be at least one-half the thickness of the adhesive band 14 in order to insure that the section of substrate bearing the adhesive segments 20 and 22 does in fact bond to the pages.

Adhesive segments 20 and 22 comprise a heat-activated adhesive. The viscosity of this heat-activated adhesive, under activation conditions, should be greater than that of the adhesive band 14, and preferably greater than 20,000 cps with a viscosity of 50,000 cps being even more preferred. The higher the viscosity at activation conditions, the less the adhesive flows. When adhesive flow is minimized it is easier to predict the adhesive distribution in finished bindings. Therefore it is possible to place the adhesive segments 20 and 22 close to the end of the substrate 12 so that in the finished binding, these adhesive segments will bind the entire substrate 12, without a hanging fringe, and without adhesive run out as explained above.

It is possible to use the same adhesive for adhesive segments 16, 18, 20 and 22, but it is not required. A heat-activated adhesive manufactured by the H. B. Fuller Company of St. Paul, Minn., which is designated by product no. HM-1777, has been found suitable for comprising adhesive segments 16, 18, 20 and 22.

FIGS. 4 and 5A–5F are referenced to describe one method of manufacturing an embodiment of the adhesive binding strip. The elements will be described in the order in which they act on a strip in manufacture. A feed roll 100 of appropriate substrate material is supplied and rotatably constrained to allow feeding of a substrate material 200 in the longitudinal direction of the finished strips. The roll may be as narrow as the substrate strip to be produced, or may be wide enough to produce more than one strip side by side.

Figure 5A:
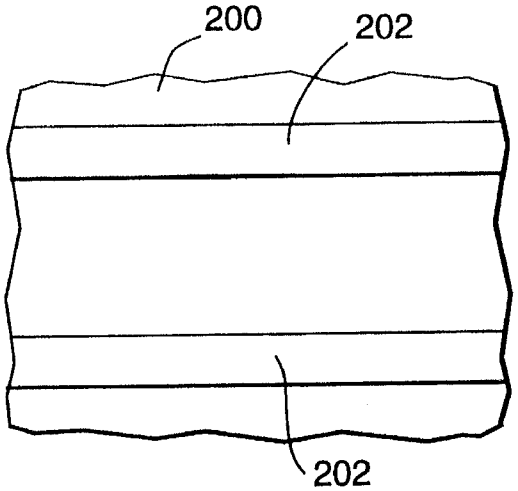
FIG. 5A, 5B, 5C, 5D, 5E and 5F are partial plan views of an embodiment of the invention at various points during an embodiment of the subject manufacturing process.

Ribbon coater 102 continuously applies lines of adhesive 202 which will comprise adhesive segments (corresponding to segments 16 and 18 of the FIG. 1 embodiment) in the finished strip. The ribbon coater works by feeding heated, activated adhesive in the plastic state through a slot die (not shown). The slot die has a pattern of openings corresponding to the desired pattern of adhesive to be applied. FIG. 5A shows a segment of substrate stock, approximately one strip wide, after adhesive dispenser 102 has applied adhesive lines 202.

After application of the hot adhesive by ribbon coater 102, it may be desirable to cool the substrate 200 and adhesive lines 202 to prevent flow of the hot adhesive. This can be done by means of a chill wheel 104*a*. The chill wheel 104*a* can also be rotatably driven by means (not shown) to provide some of the force necessary to cause the feed roll 100 to feed. A similar chill wheel may be used subsequent to each step at which hot adhesive is applied. The embodiment of FIG. 4 utilizes three chill wheels 104*a*, 104*b* and 104*c*.

Figure 5B:
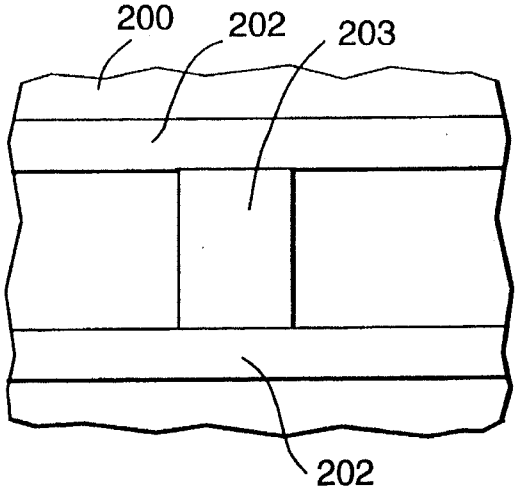
Figure 5C:
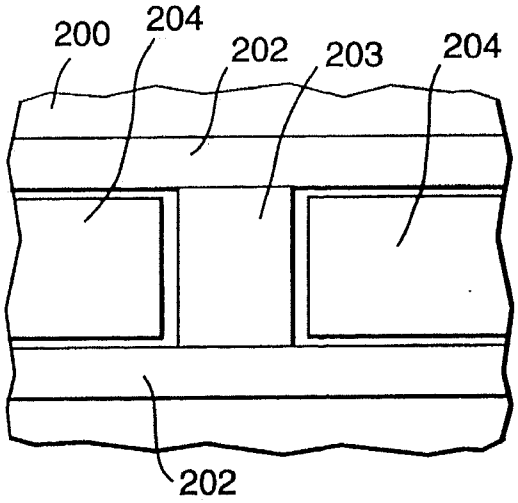
Figure 5D:
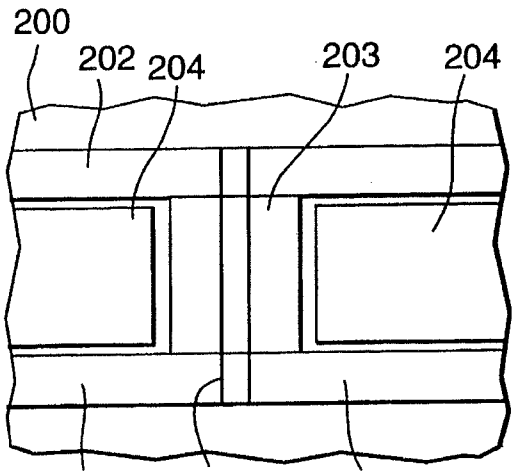
Figure 5E:
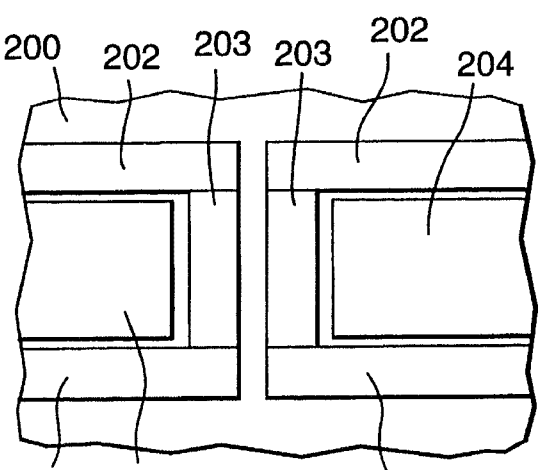

Ribbon coater 106 intermittently applies adhesive segments 203, as shown in FIG. 5B, which will comprise adhesive segments (corresponding to segments 20 and 22 of FIG. 1 embodiment) in the finished strip. The adhesive segment applied by ribbon coater 106 should be at least twice as long, in the longitudinal direction, as the desired adhesive segment of the finished strip. Ribbon coater 108 intermittently applies an adhesive band 204, as shown in FIG. 5C, which will comprise the adhesive band (corresponding to adhesive band 14 of the FIG. 1 embodiment) in the finished strip.

Die cutter 110 comprises two precisely spaced wheels. The wheel contacting the adhesive side of the substrate roll has a blade which cuts pairs of incisions 206 through the adhesive lines 202 and adhesive segments 203, but not through the substrate 200. These incision pairs 206 are placed equidistantly on either side of a line which bisects adhesive segment 203 normal to longitudinal direction. This bisecting line represents the end of the finished strip. The incision pairs 206 are placed at some small distance about this line to allow for a gap between the adhesive segment and the edge of the substrate in the finished strip.

A heated wheel 112 heats the substrate and adhesives sufficiently to make the adhesives somewhat tacky and to cause the adhesive to release from the substrate. This facilitates peeling of the adhesives by adhesive peeling means 114. Adhesive peeling means 114 peels off all adhesive in the area between the incision pairs 206. A set of drive wheels 116 provides any additional force required to drive feed roll 100.

Figure 5F:
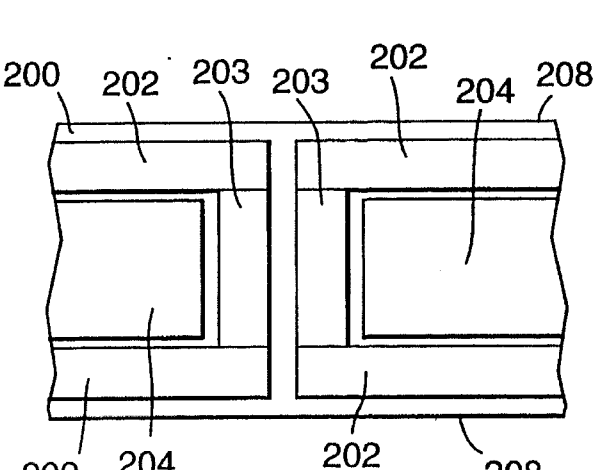

Slit cutter 118 cuts a set of continuous, parallel slits 208 in the longitudinal direction. These slits 208 will form the longitudinal edges of finished strips. These slits may be placed so that there is a small gap between the adhesive lines 202 and the slits 208 as shown in FIG. 5F, in order to allow for a gap between the longitudinal adhesive segments and the edges of a finished strip.

Chop cutter 120 cuts the roll at regular intervals to form the edges of the finished strips which run normal to the longitudinal direction. The chop cutter 120 makes its cuts along the centerline of the area of adhesive removed by the adhesive peeling means 114. After chopping, the strips are finished and they fall into stacking means 122.

Figure 7:
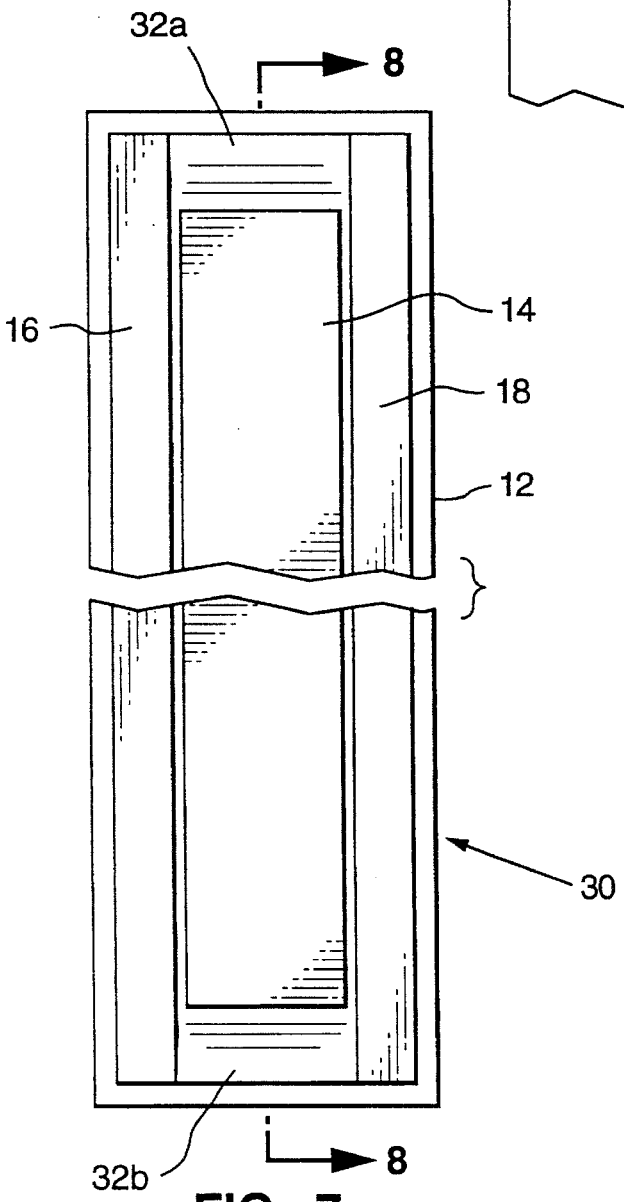
FIG. 7 is a plan view of an alternative embodiment of the subject adhesive binding strip showing the adhesive surface.
Figure 8:
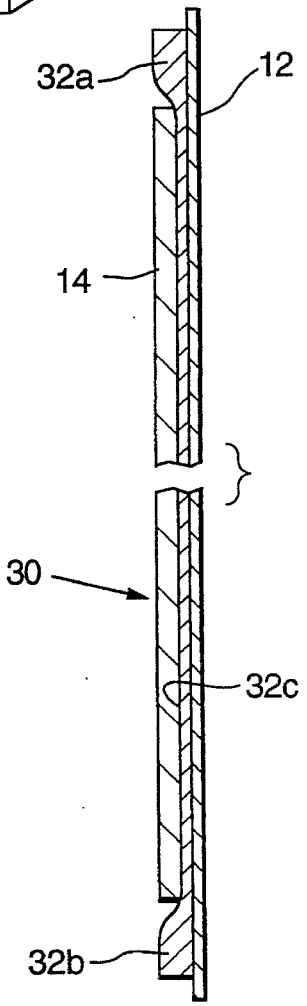
FIG. 8 shows a cross-sectional side view of the subject adhesive binding strip taken through section line 8—8 of FIG. 7.

FIGS. 7 and 8 depict an alternative embodiment binding strip where like numerals designate like elements. The alternative embodiment strip is similar to the original embodiment strip with the exception of the adhesive matrix. In the alternative embodiment strip, an adhesive strip 32, which includes segments 32*a*, 32*b* and 32*c* replace segments 20 and 22 of the first embodiment strip.

As can best be seen in FIG. 8, strip 32 includes segment 32a which provides a similar function as that of segment 20 of the first embodiment and are made of the same viscosity adhesive. Segment 32*b* of the alternative embodiment provides a similar function as that of segment 22 of the first embodiment. Intermediate segment 32C is present so that the entire strip 32 can be formed as a continuous strip without the necessity of turning the ribbon coater 106 (FIG. 4) on and off. Instead, the amount of adhesive is metered so that the thin segment 32*c* is disposed intermediate the thicker segments 32*a* and 32*b*.

The preferred thickness of segments 32*a* and 32*b* is the same as that of segments 20 and 22 of the first embodiment strip so that there is a uniform height above the substrate 12. The combination of the thickness of segment 32*c* and overlying adhesive band 14 is equal to the thickness of segments 32*a* and 32*b*. Preferably, segment 32*c* makes up one-quarter of the combined thickness and band 14 comprises the remaining three-quarters of the combined thickness. Preferably, the thickness of the adhesive segments 16 and 18 are at least half as thick as that of the central adhesive band 14.

Having described exemplary embodiments of the present invention with reference to the accompanying drawings, it is to be understood that the invention is not limited to these precise embodiments. Various changes could be effected by one skilled in the art without departing from the spirit or scope of the invention as defined in the appended claims.

What is claimed is:

1. An adhesive binding strip for binding pages together comprising:

an elongated substrate comprising formable material, said substrate including first and second edges which extend along a longitudinal axis of said substrate and third and fourth edges which extend normal to said longitudinal axis;

an adhesive band, having a thickness, disposed over said substrate along the longitudinal axis;

an adhesive matrix disposed over said substrate and extending around said adhesive band;

with said adhesive matrix having a thickness which is at least one-half the thickness of said adhesive band and wherein said adhesive matrix extends completely around said adhesive band and includes a first segment which extends between said adhesive band and said first substrate edge and is displaced from said first substrate edge so as to form a first gap and a second segment which extends between said adhesive band and said second substrate edge and is displaced from said second substrate edge so as to form a second gap; and with said adhesive band and said adhesive matrix comprising heat-activated adhesives having respective viscosities when activated, with said adhesive matrix viscosity being greater than said adhesive band viscosity.

2. The binding strip of claim 1 further comprising an adhesive layer disposed intermediate said substrate and said adhesive band, said adhesive layer having a viscosity when activated which is greater than the adhesive band viscosity when activated.

3. The binding strip of claim 1 wherein said adhesive matrix extends contiguously around said adhesive band.

4. The binding strip of claim 1 wherein said adhesive matrix includes a third segment which extends between said adhesive band and said third substrate edge and is displaced from said third substrate edge so as to form a third gap and a fourth segment which extends between said adhesive band and said fourth substrate edge and is displaced from the fourth substrate edge so as to form a fourth gap.

5. The binding strip of claim 4 Wherein said first and second gaps are of equal width.

6. The binding strip of claim 5 wherein said third and fourth gaps are of equal width.

7. The binding strip of claim 4 wherein said first, second, third and fourth segments of said adhesive matrix are comprised of adhesive having the same viscosity when activated.

8. A method of making an adhesive strip for binding pages together, which comprises:

supplying an elongated substrate comprising formable material;

depositing an adhesive band, having a thickness, over said substrate along a longitudinal axis of said substrate, said adhesive band having first and second edges which extend along said longitudinal axis and third and fourth edges which extend normal to said longitudinal axis;

depositing an adhesive matrix over said substrate;

with said adhesive matrix including a first, second, third and a fourth segment which extend around the first, second, third and fourth adhesive band edges respectively;

with said adhesive matrix having a thickness which is at least one-half the thickness of said adhesive band;

with said adhesive band and said adhesive matrix comprising heat-activated adhesives having respective viscosities when activated, with said adhesive matrix viscosity being greater than said adhesive band viscosity; and wherein said substrate is supplied by feeding a continuous roll of the substrate material past two or more locations where said depositions of materials takes place, with the first and second matrix segments being deposited at a different location than said third and fourth adhesive matrix segments and wherein, subsequent to said feeding of the substrate roll past one or more of said locations for deposition of adhesive, said substrate roll is cooled to a temperature below the activation temperature of the adhesives comprising said adhesive matrix.

9. The method of claim 8 wherein said substrate is cooled by a chilled wheel in contact with said substrate roll and wherein said feeding of the substrate roll is effected by friction rolling contact between said chilled wheel and said substrate roll.

10. The method of claim 8 further comprising cutting said continuous roll of substrate into elongated strips.

11. The method of claim 8 further comprising: cutting away portions of said adhesive matrix; and removing said cut portion of said adhesive matrix from said substrate.

12. The method of claim 8 further including the step of depositing a further adhesive segment on the substrate intermediate the third and fourth segments of the adhesive matrix and intermediate the substrate and the adhesive band.

13. The method of claim 12 wherein the steps of depositing the third and fourth segments and the step of depositing the further adhesive segment are part of a single continuous step.

14. A method of making an adhesive strip for binding pages together, which comprises:

supplying an elongated substrate comprising formable material;

depositing an adhesive band, having a thickness, over said substrate along a longitudinal axis of said substrate, said adhesive band having first and second edges which extend along said longitudinal axis and third and fourth edges which extend normal to said longitudinal axis;

depositing an adhesive matrix over said substrate;

with said adhesive matrix including a first, second, third and a fourth segment which extend around the first, second, third and fourth adhesive band edges respectively;

with said adhesive matrix having a thickness which is at least one-half the thickness of said adhesive band;

with said adhesive band and said adhesive matrix comprising heat-activated adhesives having respective viscosities when activated, with said adhesive matrix viscosity being greater than said adhesive band viscosity;

cutting away portions of said adhesive matrix; and removing said cut portion of said adhesive matrix from said substrate.

15. The method of claim 14 wherein said substrate is supplied by feeding a continuous roll of the substrate material past two or more locations where said depositions of adhesives takes place.

16. The method of claim 15 wherein said first and said second adhesive matrix segments are deposited at a different location than said third and said fourth adhesive matrix segments.

17. The method of claim 16 wherein after said feeding of the substrate roll past one or more of the said locations for deposition of adhesive, said substrate roll is cooled to a temperature below the activation temperature of the adhesives comprising said adhesive matrix and said adhesive band by a chilled wheel in contact with said substrate roll.

18. The method of claim 17 wherein said feeding of the substrate roll is effected by friction rolling contact between said chilled wheel and said substrate roll.

19. The method of claim 18 further comprising cutting the said continuous roll of substrate into elongated strips.

20. The method of claim 14 further including the step of depositing a further adhesive segment on the substrate intermediate the third and fourth segments of the adhesive matrix and intermediate the substrate and the adhesive band.

21. The method of claim 20 wherein the steps of depositing the third and fourth segments and the step of depositing the further adhesive segment are part of a single continuous step.

* * * * *